United States Patent [19]

Tuschy et al.

[11] 4,136,543

[45] Jan. 30, 1979

[54] SKEW ROLLING MILL

[75] Inventors: Eckhard Tuschy; Georg Wischmeyer, both of Osnabruck, Germany

[73] Assignee: Kabel-und Metallwerke Gutehoffnungshuette AG, Germany

[21] Appl. No.: 888,203

[22] Filed: Mar. 20, 1978

[30] Foreign Application Priority Data

Mar. 21, 1977 [DE] Fed. Rep. of Germany ..... 2712244

[51] Int. Cl.[2] ..... B21B 13/20

[52] U.S. Cl. ..... 72/78

[58] Field of Search ..... 72/77, 78, 95, 100

[56] References Cited

U.S. PATENT DOCUMENTS

| | | | |
|---|---|---|---|
| 693,053 | 2/1902 | McIntosh et al. | 72/95 |
| 2,099,497 | 11/1937 | Offutt | 72/100 |
| 2,334,853 | 11/1943 | Wiley | 72/96 |

*Primary Examiner*—Lowell A. Larson

*Attorney, Agent, or Firm*—Marn & Jangarathis

[57] ABSTRACT

A skew rolling mill is provided with only two working rollers offset from each other by 180°. Restraining elements are provided between the rollers to prevent lateral bending of the stock being rolled.

5 Claims, 3 Drawing Figures

FIG. 2
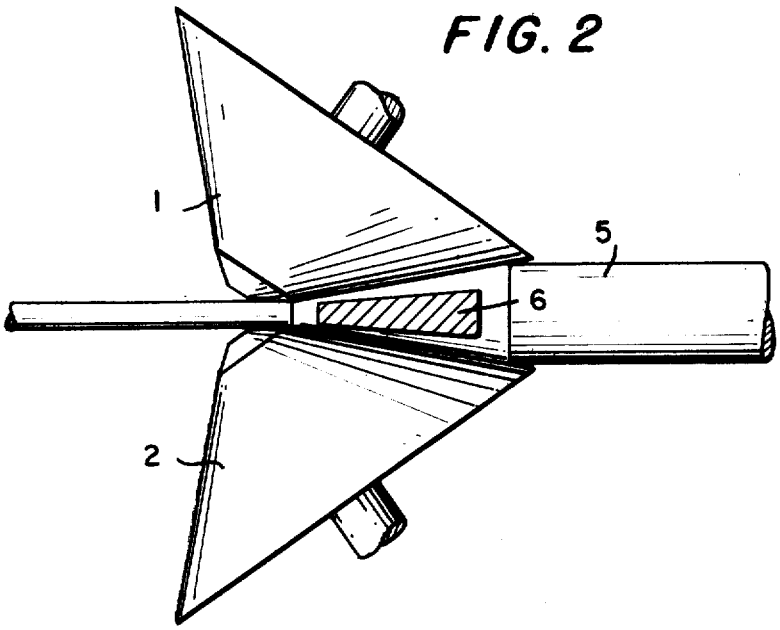
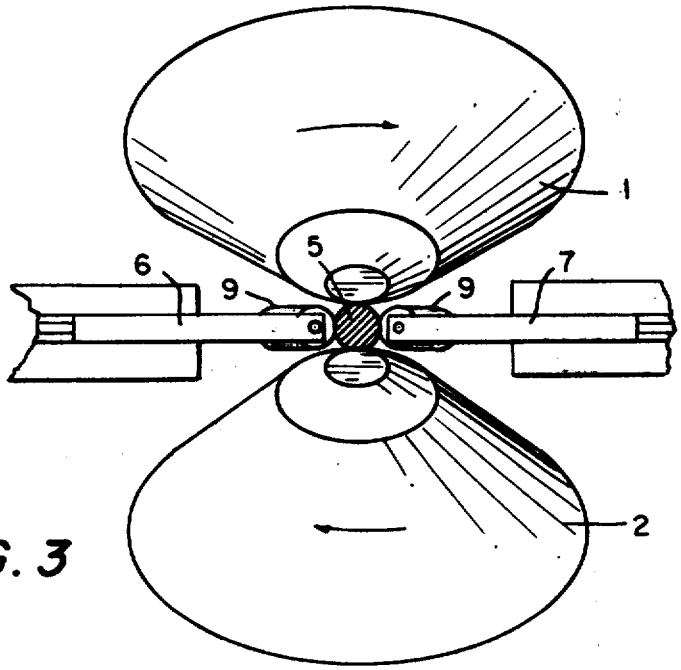
FIG. 3

SKEW ROLLING MILL

This invention relates to an improvement in a skew rolling mill of the type described in U.S. Pat. No. 3,735,617.

U.S. Pat. No. 3,735,617 describes a skew rolling mill which includes a driven roller carrier through which longitudinally extending material is moved, with the roller carrier being rotatably driven about the axis of material which is to be rolled. Three spaced frustroconically shaped working rollers are each rotatably driven in the roller carrier about an axis which intersects with the material to be rolled. The working rollers reduce the cross-section of the material, and as a result of the angular displacement of the rollers with respect to the axis of the material, the working rollers move such material.

In accordance with the present invention, the roller carrier includes only two frustroconically shaped working rollers which are spaced from each other by 180°, with restraining elements being provided between the rollers to prevent lateral bending of the material to be rolled. In accordance with the invention it is possible to roll the material to smaller cross-section. In addition, it is possible to employ larger rollers and bearings to provide for a greater degree of deformation. In this manner, it is possible to roll materials which are difficult to deform; e.g., precious steel, to smaller cross-sections.

The restraining elements are mounted on the roller carrier and are preferably provided as opposed pairs which are spaced from the working rollers by 90°. The restraining elements are positioned proximate to or in contact with the material being rolled. In accordance with a preferred embodiment, the restraining element includes a pair of freely rotatable opposed rollers which are in contact with the material being rolled to limit lateral bending thereof.

FIG. 2 is a simplified sectional view of the embodiment of FIG. 1; and

FIG. 3 is a simplified end section of another embodiment of the present invention.

Figure 1:
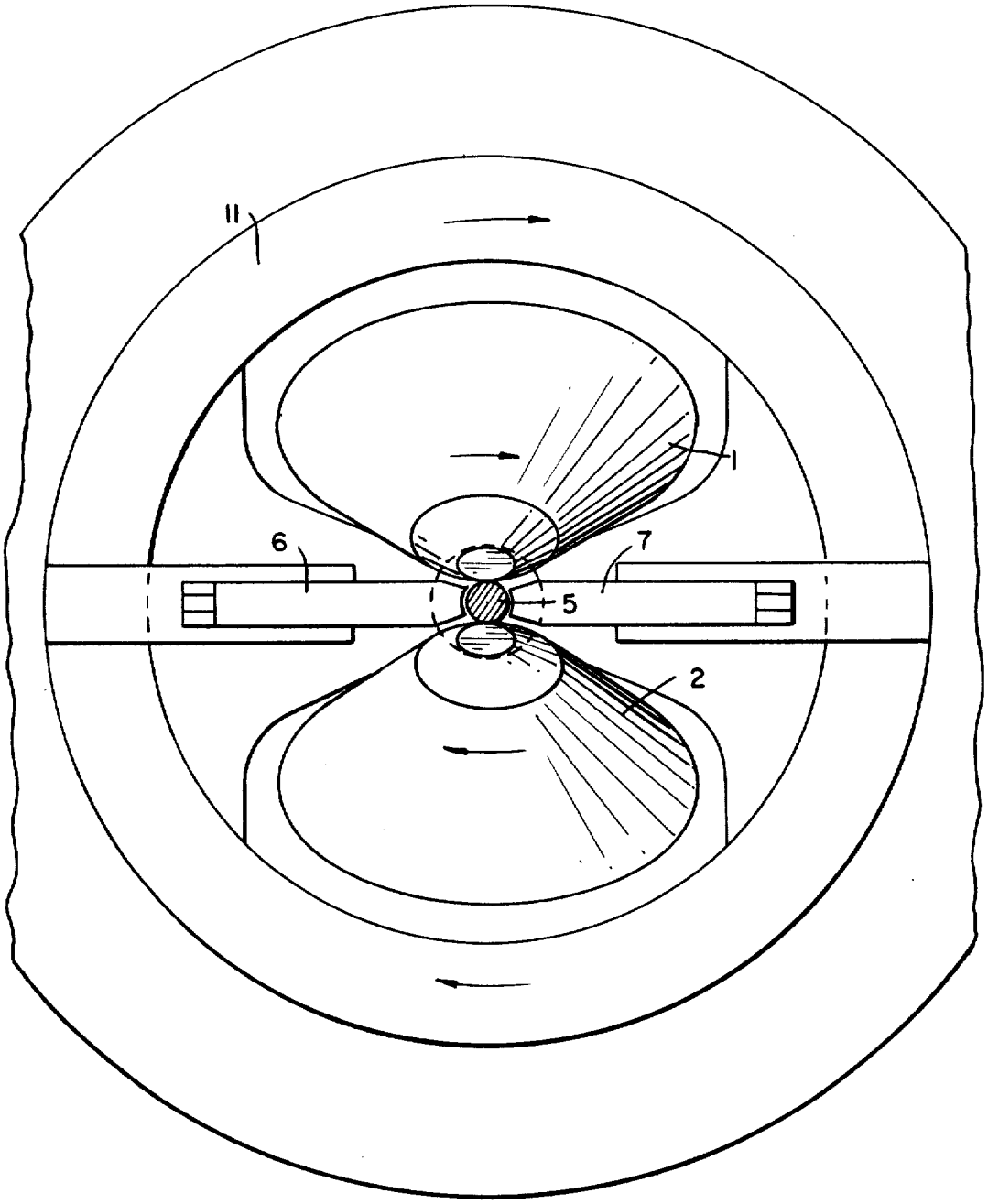
FIG. 1 is a simplified end section of an embodiment of the present invention.

Referring to FIGS. 1 and 2 of the drawings, there is shown two driven frustroconically shaped working rollers 1 and 2 which are spaced from each other by 180°. The rollers 1 and 2 are rotatably driven in roller carrier 11 about an axis which intersects with the stock 5 to be rolled. The roller carrier is rotatably driven about the axis of stock which is rolled. The working rollers reduce the cross-section of the stock, and as a result of the angular displacement thereof with respect to the axis of the stock, the working rollers move the stock in the direction of the arrow. The two working rollers 1 and 2 provide a frustrum like deformation zone on the rolled stock.

In order to prevent lateral bending of the stock, restraining bars 6 and 7 are provided between the working rollers 1 and 2, with such bars being attached to the roller carrier 11 and spaced from the working rollers 1 and 2 by 90°.

The restraining bars 6 and 7 are spaced from the stock 5 and function to push the stock 5 back into position upon bending thereof from the desired path of travel; i.e., the bars 6 and 7 limit the movement of the stock 5 to either side.

Alternatively, as shown in FIG. 3, the restraining elements include rotatable rollers 9 which are in contact with the stock. The rollers 9 are supported by the roller carrier 11. The use of rollers 9 reduces the friction between the restraining element and the stock.

Alternatively, the restraining means may take the form of one bar and one roller.

Numerous modifications and variations of the present invention are possible in light of the above teachings and, therefore, within the scope of the appended claims the invention may be practised otherwise than as particularly described.

I claim:

1. In a skew rolling mill including a rotating roller carrier which rotates about the axis of a stock to be rolled and carries rotating working rollers in contact with the stock which rotate about an axis inclined to and which intersects with the axis of the stock, the improvement comprising:

said roller carrier carrying only two working rollers spaced from each other by about 180° and restraining means positioned between the working rollers to restrain lateral bending of the stock.

2. The skew rolling mill of claim 1 wherein the restraining means are mounted on the roller carrier and are spaced from the working rollers by 90°.

3. The skew rolling mill of Claim 2 wherein the restraining means includes freely rotatable rollers which are in contact with the stock.

4. The skew rolling mill of Claim 2 wherein the working rollers have a frustroconical shape.

5. The skew rolling mill of claim 2 wherein the restraining means is a pair of opposed bars.

* * * * *